United States Patent [19]

Mosser et al.

[11] Patent Number: 4,544,408

[45] Date of Patent: Oct. 1, 1985

[54] THIXOTROPIC ALUMINA COATING COMPOSITIONS, PARTS AND METHODS

[75] Inventors: Mark F. Mosser, Sellersville; Kevin Eddinger, Gilbertsville, both of Pa.

[73] Assignee: Sermatech International Inc., Limerick, Pa.

[21] Appl. No.: 485,748

[22] Filed: Apr. 18, 1983

[51] Int. Cl.[4] ..... C09D 5/08

[52] U.S. Cl. ..... 106/14.12; 106/14.21; 148/6.16

[58] Field of Search ..... 106/14.12, 14.21, 286.2; 148/6.16

[56] References Cited

U.S. PATENT DOCUMENTS

| | | | |
|---|---|---|---|
| 3,031,322 | 4/1962 | Bugosh | 106/286.2 |
| 3,248,251 | 4/1966 | Allen | 106/286.2 |
| 3,562,011 | 2/1971 | Hirst et al. | 428/450 |
| 4,238,534 | 12/1980 | Ichida et al. | 427/376.5 |
| 4,373,968 | 2/1983 | Hess | 148/6.16 |

*Primary Examiner*—Lorenzo B. Hayes

*Attorney, Agent, or Firm*—Weiser & Stapler

[57] ABSTRACT

A stable thixotropic coating composition especially suitable for dipspin application having an aqueous acid binder solution which comprises phosphate ions and ions of the group of chromate ions or molybdate ions, and a dispersible hydrated alumina having a boehmite type crystal lattice.

29 Claims, No Drawings

THIXOTROPIC ALUMINA COATING COMPOSITIONS, PARTS AND METHODS

This invention relates to stable thixotropic coating compositions which are ideally suited for application to parts to be coated by dipspinning or dipping. The coated metal parts excel in performance in that they are highly resistant to severe atmospheric and other corrosive conditions to which they are exposed.

The invention also relates to the metal parts coated with such compositions and to a method for coating metal parts. More particularly, the invention relates to acid chromate phosphate aqueous compositions which comprise certain defined aluminas.

It is known that phosphate and chromate/phosphate coatings are useful to protect metal surfaces. Traditionally the method of application has been by spraying, dipping or other methods of application. Because of the relatively fluid nature of traditional phosphate and chromate/phosphate compositions, there is a considerable loss and waste of the coating composition and/or an incomplete coating of more intricate metal parts. Various attempts to thicken coating compositions such as with diatomaceous earth have been unsatisfactory. Other additives to coating compositions (such as phosphate compositions) like hydroxymethyl cellulose, polyvinyl acetate, modified sugars, latex and other synthetic organic materials and resins have been unsatisfactory. When thickeners like alginates, gum or others are used, the composition must be buffered at a high pH to avoid splitting (scissoring) the polymeric thickener. Such a higher pH is not acceptable for the practice of the invention. It is known that such thickeners are split primarily because of the oxidizing characteristic of the chromate (dichromate) ions at prevailing low pH. Those conventional thickeners which are not affected by the chromate ions merely dilute the composition and adversely affect its coating characteristics. The present invention uses chromate at a low pH, and yet the additives (boehmite alumina, fumed alumina, silica and/or nonionic surfactant) are stable in the medium.

U.S. patent application Ser. No. 441,754 filed Nov. 15, 1982 discloses a thixotropic coating composition utilizing amorphous silicas and nonionic surfactants.

U.S. Pat. No. 3,856,568 to Tanaka discloses a coating solution containing colloidal silica which improves iron loss and other properties on oriented silicon steel sheets.

U.S. Pat. No. 2,465,247 to McBride discloses the treatment of ferrous, zinc and cadmium metal surfaces with a paste-like composition to produce a phosphate coating and a readily removable powdered layer upon drying. The paste-like composition is produced by supplying a porous silica aerogel with an aqueous solution capable of producing phosphate films. An anionic surfactant, an alkyl aryl sulfonate (like Naconal) is also a component of the composition. The coating on drying has a loose fluffy aerogel layer that comes off readily by wringing, brushing or with a blast of air.

Gilchrist (U.S. Pat. No. 3,615,741) discloses chromium-containing compositions including a hydrated chromic oxide and a hydrophobic organic acid which contribute to a thickening or gelling of the product. The product has an alkaline pH above 7, usually 8 to 9. Kendall (U.S. Pat. No. 3,536,629) discloses a nonaqueous paint remover which contains pyrogenic silica, in addition to other traditional components. Ayres (U.S. Pat. No. 3,420,715) discloses phosphate coating solutions that include a nonionic detergent as a cleaning agent which is consumed entirely.

For quite some time there has been a need to coat metal parts by what is called the dipspin or Filwhirl methods. In these methods, the parts are painted in bulk, that is by the basketful, avoiding time consuming handling of individual pieces. Irregularly shaped parts such as coils, springs, screws, valves and wheels, castings, bolts, washers, fasteners, etc. are coated by such methods. The dipspin coating method reduces application costs significantly and covers even difficult to reach or normally inaccessible surfaces. The method eliminates sagging of the finish and parts need not be hung individually for drying. In the method, the parts are loaded into a removable work basket and then dipped into a tank or drum of the coating composition. After immersion, the filled basket is raised, allowed to drain momentarily and then spun to remove excess coating. It is taken out and the parts dumped onto a screen to dry. The parts can also be dried by spinning in the machine. Any surplus coating which is thrown off the parts generally flows through an outlet and is collected and recycled to the tank. The Filwhirl process is a modification wherein the basket full of parts to be coated is immersed in a vat into which a coating composition is pumped to flood the basket, which is then spun. Because of the relatively fluid nature of traditional chromate/phosphate compositions, there is a considerable loss and waste of the coating composition and/or an incomplete coating or more intricate metal parts when coated by the dipspin or Filwhirl methods.

An object of this invention is to provide a coating which is fluid enough to reach into and/or cover the concave or intricate portions of a metal part to be coated, and yet not so fluid as to throw off much of the coating during a spinning cycle so that the part is not completely coated with the composition. The coating compositions of the invention satisfy this requirement. Moreover they remain stable, i.e. the components are not oxidized and they do not significantly settle or classify into various components or layers for several months at room temperature. The major proportion of the pigment does remain in suspension and does not settle at the bottom of the container. This is an important requirement when the composition is to be used over and over again or when shipped from the manufacturer to the applicator.

In accordance with the invention, a particular coating composition has now been found which is thixotropic and which is stable, i.e. it does not undergo degradation and does not classify or separate into its components, upon long storage periods (shelf stability) under conditions of use. Also, it is ideally suited for application by the dipspin technique.

It is noteworthy that in accordance with the invention, a greater latitude is provided in the type of chromate/phosphate compositions which can be used. For instance, with respect to the Allen U.S. Pat. No. 3,248,251, it is not necessary that the phosphate binder be confined to the various concentrations and other molar relationships disclosed by that patent. The present invention, therefore, allows for the use of a large number of and a great variety of acid binder solutions for making the thixotropic coating compositions. In accordance with the invention, the stable thixotropic coating composition of the invention comprises, in addition to the acid binder which comprises phosphate ions and ions of the group of chromate or molybdate ions, an alumina of the type defined below.

Moreover, the coated parts, e.g. metal parts, have a combination of unusual and unique properties in that they are resistant to corrosive atmospheric conditions, particularly extreme salt spray exposure, heat exposure and humidity. The coated parts may be, if desired, further treated such as to render them galvanically active. Also top coats, with pigments if desired, may be applied.

The invention contemplates an acid stable thixotropic coating composition which comprises a chromate/phosphate aqueous composition having as an essential ingredient a dispersible natural or synthetic hydrated alumina having a boehmite or pseudoboehmite crystal lattice. In this invention the term "boehmite" is generic to and includes "pseudoboehmite", and reference to the former includes the latter, unless specifically stated otherwise. Other ingredients in the composition of the invention are optional. Such other ingredients include fumed alumina, certain silicas and nonionic surfactants. These are described further below.

The acid thixotropic compositions of the invention are constituted or made from aqueous solutions which preferably contain phosphate anions and chromate (or dichromate) and/or molybdate anions. A great variety of such solutions is known for treatment of metal surfaces. For instance, Kirk and Othmer, Eds., *Encyclopedia of Chemical Technology,* 2nd ed., vol.18, Interscience Publishers, a division of John Wiley & Sons, Inc., 1969 (pages 292–303), describes phosphate and chromate coatings. The United States patent literature describes coating solutions or dispersions for protective coating of metals, which compositions are suitable for use as components of the compositions of the invention. Such suitable compositions are disclosed by Allen (U.S. Pat. No. 3,248,251); Braumbaugh (U.S. Pat. No. 3,869,293); Collins (U.S. Pat. No. 3,248,249); Wydra (U.S. Pat. No. 3,857,717); Boies (U.S. Pat. No. 3,081,146); Romig (U.S. Pat. No. 2,245,609); Helwig (U.S. Pat. No. 3,967,984); Bennetch (U.S. Pat. No. 3,443,977); Hirst (U.S. Pat. No. 3,562,011) and others. These disclosures are incorporated herein by reference. Other illustrative patents or literature showing corrosion inhibiting and protective coating compositions of phosphates, mixtures of phosphates and chromates and/or molybdates are known to one skilled in the art and further examples it is believed need not be supplied.

The aluminas which are utilizable in accordance with the invention to produce the thixotropic compositions are dispersible hydrated aluminas having the boehmite (or pseudoboehmite) crystal lattice. The term "dispersible" refers to being capable of being acid dispersed to an ultimate colloidal particle in an aqueous monoprotic acid medium.

Suitable for the invention are the hydrated aluminas having a boehmite crystal lattice which are available commercially under the trade name "Dispural" by Remet Corporation and under the trade name "Catapal" by Conoco Chemicals Company of which descriptions of their characteristics are as follows:

| | Catapal | Dispural |
|---|---|---|
| $Al_2O_3$ | 74.2% | 76.5% |
| Carbon | 0.36% | 0.5% |
| $SiO_2$ | 0.008% | 0.008% |
| $Fe_2O_3$ | 0.005% | 0.005% |

-continued

| | Catapal | Dispural |
|---|---|---|
| $Na_2O$ | 0.005% | 0.004% |
| S | 0.01% | 0.005% |
| Surface area (BET) | 280 $m^2$/gm | 320 $m^2$/gm |

Other suitable aluminas are disclosed in U.S. Pat. No. 4,371,513, which patent is incorporated herein by reference.

To prepare the thixotropic compositions of the invention, a water/acid dispersion of the hydrated alumina premix is made and added to a chromate/phosphate composition. In preparing the dispersion, the amount of alumina utilized is about 1 to about 30% by weight based on the total dispersion. More preferably, about 10–20% by weight of alumina is dispersed in a mixture of water and a monoprotic acid. When less than about 1% by weight of the alumina is used the results are not as satisfactory as one would want for most applications; whereas for most applications over about 30% by weight might not be the most economical composition. But if desired, the dispersion may contain over 30% of the alumina. The dispersion may have a pH range of about 1.0 to about 4.0, preferably 3.5 to about 4.0. Usually, this amounts to about 0.1 to about 4.0% by weight of the dispersion of the monoprotic acid, depending upon the acid utilized. Among the monoprotic acids which may be utilized are nitric acid, hydrochloric acid, hypophosphorous acid, acetic acid, propionic acid, lactic acid, glycolic acid and sulfamic acid. Most preferable of these acids are nitric acid, hypophosphorous acid and acetic acid. The particular acid utilized should be inert to the substrate on which the coating is placed. It is especially advantageous to utilize hypophosphorous acid since a dual thickening effect occurs: (1) the gelling of the dispersed alumina, and (2) the reduction of the chromate in the chromate/phosphate binder to gelatinous chromium chromate or hydroxide by the hypophosphorous acid. This desirable effect appears to be greater than that contributed by the acid on the chromate solution alone or the thickening contributed by the addition of the alumina dispersion. The actual viscosity of the acid/alumina dispersion may cover a wide range. In fact the dispersions may be water thin or so thick as to have a paste-like consistency.

It will be noted that viscosity measurements (cp) of the products disclosed here are made with a Brookfield Helipath LVF. This device measures shear forces along a vertical path throughout the composition rather than at one location as with other viscosity measuring devices.

To prepare the thixotropic compositions of the invention, the water/acid dispersion of the hydrated alumina premix described above is made and added to the chromate/phosphate composition. In the premix dispersion it is believed that the monoprotic acid disperses the agglomerates of the alumina and that when the dispersed alumina is added to a solution containing divalent or trivalent ions or even positive monovalent ions other than $H^+$, the alumina is caused to gel and a thixotropic mixture is formed. The pH of the final composition is generally in the range of about 0.0 to about 3.0, preferably in the range of 1.5 to about 3.0. The dispersion is added to the chromate/phosphate composition so as to prepare a coating composition having an alumina content range which is preferably about 1 to about 10% by weight based on coating solids, more preferably about 3 to 6%. This results in a final coating composition which preferably has a viscosity of about 800 to about 50,000 centipoise; a coating having a viscosity range of about 1,500 to 10,000 centipoise has been found to be desirable when parts are to be coated by the dip-spin method.

It should be noted that an overlap with respect to the viscosity may exist between the compositions of the invention and those of the prior art. Highly pigmented compositions of the art may have high viscosity, yet not be thixotropic and/or suitable for dip or dipspin coating methods.

Although these ranges of pH and viscosity are given as a guidance, it is contemplated that by varying one or more of the ingredients of the composition and if more specialized applications are desirable, there are circumstances in which one skilled in the art may wish to prepare a thixotropic coating composition where one or more of the ingredients may be outside of the specified limits. For instance, it is contemplated that compositions of higher viscosities will produce ultra thick coatings which, though not as desirable for metal parts with intricate shapes and forms or tighter tolerances, are quite suitable for other metal parts to be coated. It is also contemplated that such higher viscosity coatings are quite acceptable if the spinning cycle speed is measurably increased to create such forces as to liquify and spread the coating over the surface to be coated even on more intricate parts.

On the other hand, if the minimum viscosity limits for the compositions are not observed (for instance as with thixotropic compositions with centipoise below 1,000, such as about 800), the film formed on the metal part may not be continuous. Where this is not essential, such lower viscosity compositions are quite acceptable too. Because of the procedural leeway allowed in the dip and dipspin techniques, such decrease of viscosity of the thixotropic coating compositions may also be accommodated by an adjustment in the rate of withdrawal of the coated metal part, addition of another spin cycle, or a decrease in the spin time or speed. Thus it will be seen that it is within the contemplation of the invention that one skilled in the art may operate outside of the preferred parameters disclosed above without avoiding the spirit of the invention.

It has been found to be advantageous but not necessary to utilize fumed alumina in the compositions of the invention. When fumed alumina is added to chromate/-phosphate compositions, it has little thickening effect. However, when utilized in conjunction with the alumina/acid/water dispersions of the invention, the fumed alumina aids significantly to producing a thixotropic coating. The fumed alumina can be added to the chromate/phosphate composition together with, before or after the alumina dispersion without any significant change in the end result. The amount of fumed alumina to be added to the chromate/phosphate composition need generally not be more than about 10%, preferably from about 0.25 to about 5% of the total solids in the coating composition.

An amorphous silica ingredient may also be used in the coating composition of the invention. It is a substantially dehydrated, polymerized silica which may be considered as a condensation polymer of silicic acid. Such amorphous silicas are known. It is generally accepted that the amorphous silicas are usually categorized as silica gel, precipitated silica, fumed silica or colloidal silica. For the purpose of this invention it has been found that the fumed silica, precipitated silica and silica gel are ideally suited. The silica should be added to the chromate/phosphate composition preferably in the range of 0 to 10% by weight based on the total solids of the composition. To be used in conjunction with the amorphous silica additions is a water soluble, acid stable nonionic surfactant. Suitable nonionic surfactants for use in the invention are disclosed in Kirk & Othmer, *Encyclopedia of Chemical Technology*, vol. 19, pages 531 to 554, entitled "Nonionic Surfactants," which is incorporated herein by reference. The nonionics used herein are adequately stable and inert to the acidic conditions prevailing in the binder and the compositions of the invention. It is preferred that the coating compositions contain from about 0.01 to about 5% by weight and more preferably about 0.02 to 0.6% by weight of the surfactant based on total solids.

Another group of highly favored thixotropic coating compositions of the invention are those which contain a reduced chromium component. Such thixotropic coating compositions have properties enhanced by the presence of trivalent chromium (reduced hexavalent chromium) which forms a gel which comprises typically chromium chromate and/or chromium hydroxide. In accordance with the invention the soluble hexavalent chromate in the binder is therefore reduced to trivalent chromium such as $Cr(OH)_3$ or $Cr_2(CrO_4)_3$. These trivalent chromium-containing gels contribute to the reinforcement of the three dimensional network.

In accordance with the invention, the above described effect can be accomplished with any chromium-reducing reagent. Suitable for that purpose are hydrogen peroxide, hydrogen peroxide-generating reagents, phosphoric acid-generating reagents such as hypophosphorous acid, phosphorous acid or the salts thereof, such as the alkali metal, alkaline earth metal and the like. Organic reducing reagents include the alkanols, such as methanol, ethanol, isopropanol, and the like, and polyhydric alcohols such as ethylene glycol, sorbitol and glycerine, or other equivalent reagents may be used. Preferred among the reducing reagents are those which do not produce extraneous ions which would have an adverse reaction on the other components of the system. For instance, hydrogen peroxide is a preferred reagent because the by-product is water. Inorganic and organic peroxides are also suitable. Other preferred reagents are those which are phosphate-generating or phosphate and water-generating. As the reduction takes place the pH of the composition increases.

In accordance with the invention there is a class of thixotropic compositions which is even more preferred. These thixotropic compositions comprise insoluble particles which are incorporated in the chromate/phosphate composition. Solid particulate materials (metals and nonmetals) suitable for admixing to the composition are known. For instance, see the Allen U.S. Pat. No. 3,248,251, which is incorporated herein by reference. Among these inorganic particles are aluminum, chromium and zinc. Aluminum particles are most preferred. Ideally the aluminum particles are of a very small size, such as atomized aluminum. The size preferably does not exceed 50 microns and ideally is below 10 microns.

Other particulate solid materials which may be added to the coating composition of the invention include zinc, oxides of zirconium, beryllium, iron or chromium, the refractory carbides, nitrides, silicides, or borides, or the alloys thereof. Preferable among the particulate solid materials is aluminum or aluminum alloys. Generally, the particulate solid material is of an average particle size similar to the range given above. When a solid particulate material is to be a component of the composition, it is generally preferred that it be admixed at least by the time of the addition of other components of the invention, particularly the alumina and/or fumed alumina dispersion.

In accordance with the invention there is therefore made available an ideal thixotropic coating for intricate metal parts ideally suited for the dipspin techniques. This composition supercedes bulk process and the plating techniques used heretofore. It also provides, as disclosed above, very significant savings in time and in material over, for instance, the spraying process.

As explained above, while the purpose of the invention is primarily to apply the coatings by the dipspin process, the thixotropic coating compositions may also be sprayed on, rolled on, brushed, dipped or flow or coil-coated. When, in accordance with the invention, the dipspin process is used, the process of the invention proceeds as described above.

In accordance with the invention any metal may be coated with the composition of the invention including steel, stainless steel, aluminum, titanium, i.e. any metal that can be heated to an appropriate curing temperature, e.g. approximately 525° F. Likewise alloys of these metals can be coated. While especially desirable for coating metal parts, nonmetallic surfaces may be coated also, like plastics, ceramics, fibrous materials, etc.

It should also be noted that the coating or film on the metal part may be made very uniform such as about 0.5 mil±0.1. This is particularly advantageous when metal parts are of intricate design and shape which then need to be fitted together, such as screws and nuts which need to be threaded together.

In accordance with another aspect of the invention as has been disclosed above, the coated part may then be further coated with a top coat to add any desired characteristics such as increased lubricity, UV resistance, light resistance, detorque resistance, and a metallic or zinc plated appearance. Yet, parts so produced in accordance with the invention will have remarkably greater corrosion resistance and other desirable properties. Moreover, coated parts produced in accordance with the invention may also be given a post treatment of an inorganic top coat containing a ceramic oxide and other types of pigment thereby increasing the heat resistance.

Thus, the coated parts produced in accordance with the invention are ideally suited for application of additional top coats or post treatments for making them even better suited for the desired application.

From the above disclosure it will now be appreciated that a significant contribution has been made in the field of coating metal or nonmetallic parts.

The following examples are illustrative of the invention and are not intended to be limiting. It is evident to one skilled in the art that the ingredients of the various compositions illustrated, their relative proportions and amounts, as well as other variables and parameters can be modified while being within the scope and the contemplation of the invention, and that the equivalents of what is disclosed herein are also contemplated to be within the scope of the invention.

EXAMPLE 1

A coating composition of the invention was prepared by mixing the following ingredients:

Magnesium oxide: 58.2 g
Chromic acid: 286.0 g
Phosphoric acid (85%): 856.3 g
Magnesium carbonate: 180.8 g
Water: 2,108.25 g
Aluminum powder (−325 mesh, particle size 5–10 microns): 3,103.5 g To 620 g of the mixture, 428 g of a premixed 10% boehmite dispersion was added by stirring. The dispersion was prepared as follows:

Water: 447 g
Hypophosphorous acid (50%): 3.6 g
Dispersible boehmite alumina: 45 g The composition has the following characteristics:

pH before dispersion addition: 1.6
viscosity before dispersion addition: 996 cp
pH after dispersion addition: 2.2
viscosity after dispersion addition: 1,660 cp Steel parts such as screws and fasteners are coated with the composition using the dipspin method. The coating is dried at 175° F. and then cured at 650° F. To make the coating electrically conductive, the cured parts are burnished in a blaster using aluminum oxide grit (or glass beads at low pressure). The coated parts had excellent resistance to standard salt spray and corrosion tests.

Similarly, a premixed dispersion may be made utilizing other monoprotic acids including nitric acid, acetic acid, propionic acid, lactic acid, glycolic acid and sulfamic acid.

EXAMPLE 2

A coating composition of the type disclosed by Allen (U.S. Pat. No. 3,248,251) was prepared. No pigment was added by hypophosphorous acid was used to partially reduce the chromate.

Magnesium oxide: 300 g
Chromic acid: 231 g
Phosphoric acid (85%): 1,487.5 g
Aluminum hydroxide: 57.8 g
Hypophosphorous acid (50%): 18 g
Water: 3,050.0 g To 520 g of the mixture, 428 g of a 10% alumina dispersion using nitric acid was added by stirring. The preparation of the dispersion was as follows:

Water: 447 g
Concentrated nitric acid: 4.2 g
Dispersible boehmite alumina: 45 g

The composition has the following characteristics:

pH before dispersion addition: 2.15
viscosity before dispersion addition: 581 cp
pH after dispersion addition: 2.6
viscosity after dispersion addition: 1494 cp The composition may be used for application as a top coat over coatings like the composition in Example 1. The top coat is applied by the dipspin method directly on top of the previous coating. It is dried at 175° F. and cured at 650° F. When used on various steel parts including fasteners the corrosion resistance of the coating system is greatly increased.

EXAMPLE 3

The following is a composition based on that disclosed by Braumbaugh (U.S. Pat. No. 3,869,293):

Magnesium oxide: 205.4 g
Chromic acid: 263 g
Phosphoric acid (85%): 1,028.5 g
Water: 2,297 g Aluminum powder (−325 mesh, particle size 5–10 microns, average): 1,119.5 g Aluminum/magnesium alloy powder (70% Al, −325 mesh): 1,117 g 110 g of a 15% DISPURAL*/$HNO_3$ dispersion was slowly added to 620 g of the above composition while stirring. The viscosity increased from 581 cp to 1,079 cp. The pH increased from 2.6 to 2.9.

*DISPURAL is a trademark of Remet Corporation for acid dispersible alumina monohydrate of the boehmite type.

This composition was applied to steel fasteners using a dipspin apparatus. The coating was dried at 175° F. and cured at 750° F. A top coat of a suitable organic paint was applied and cured at 350° F. Metal parts coated with the composition were highly resistant to extreme weathering conditions.

EXAMPLE 4

Example 3 was repeated but 220 g of the dispersion were added. The observed viscosity increase was from 581 cp to 4,482 cp. The pH change was from 2.6 to 2.9.

Metal parts coated with the composition were highly resistant to extreme weathering conditions. The exposure of the part to salt spray testing was remarkably improved.

EXAMPLE 5

Example 3 was repeated but 204 g of the following 20% dispersion was substituted:

Water: 400 g

Glycolic acid: 10 g

Dispersible boehmite alumina: 80 g

The dispersion was mixed by blending at high speed for five minutes. The viscosity was originally 581 cp and increased to 10,624 cp on addition of the dispersion.

Similarly, a dispersion may be prepared utilizing a synthetic alumina having a pseudoboehmite crystal lattice.

EXAMPLE 6

The composition prepared in Example 2 was repeated, but 3.79 g of fumed silica and 0.2 g nonionic surfactant were additionally added. The viscosity after adding the dispersion was 1,494 cp. After adding silica and the surfactant the viscosity increased to 5,561 cp where it remained stable.

Metal parts coated similar to the process described in Example 2 were highly resistant to extreme weathering conditions.

EXAMPLE 7

The same binder composition as in Example 2 was prepared but 10 g of fumed alumina was added along with 104 g of the following dispersion:

Water: 350 g

Hypophosphorous acid (50%): 60 g

Dispersible boehmite alumina: 80 g

The composition was mixed by blending at high speed for five minutes and had the following characteristics:

pH before dispersion/alumina addition: 2.15 viscosity before dispersion/alumina addition: 581 cp pH after dispersion/alumina addition: 2.65 viscosity after dispersion/alumina addition: 4,150 cp

Steel specimens such as screws and fasteners are dipped in the coating composition, dried at 175° F., and cured at 650° F. After dipping in a suitable organic top coat and curing at 350° F., the coated specimens have excellent resistance to salt spray and corrosion tests.

EXAMPLE 8

A coating composition was prepared by mixing the following ingredients:

Chromic acid: 72 g

Phosphoric acid (85%): 170 g

Water: 960 g

Aluminum powder (−325 mesh, particle size 5–10 microns avg.): 480 g

No metallic cation is added.

To 528 g of the above mixture, 132 g of the 20% dispersion used in Example 7 was added and blended for five minutes. The viscosity of this composition was 1,079 cp as compared to 664 cp prior to addition of the dispersion.

EXAMPLE 9

The base coating used in Example 8 was prepared. To 528 g of the coating, 132 g of the 20% boehmite alumina/glycolic acid dispersion used in Example 5 was added and blended for five minutes. The viscosity of the mixture increased from 664 cp to 996 cp.

EXAMPLE 10

A binder composition of the type disclosed by Wydra (U.S. Pat. No. 3,857,717) was prepared as follows:

Water: 2,953 g

Phosphoric acid (85%): 843 g

Phosphorous acid: 555 g

Chromic acid: 697 g

No cations were added but phosphorous acid was used to react with some of the chromic acid.

428 g of the dispersion used in Example 2 was slowly added to 600 g of the above composition. The pH changed from 0.55 to 1.20. The viscosity increased from 581 cp to 1,245 cp.

EXAMPLE 11

A binder composition of the type disclosed by Allen (U.S. Pat. No. 3,248,251) is prepared according to the following formula:

Magnesium oxide: 72.5 g

Chromic acid: 92.0 g

Phosphoric acid (85%): 318 g

Deionized water: 805 g

To 512 g of this mixture, 428 g of the 10% alumina dispersion used in Example 2 was added by stirring. The mixture had the following characteristics:

pH before dispersion addition: 1.60 viscosity before dispersion addition: 415 cp pH after dispersion addition: 2.1 viscosity after dispersion addition: 1,328 cp

EXAMPLE 12

Example 11 was repeated except the following dispersion was substituted:

Water: 447 g

Concentrated nitric acid: 4.2 g

Dispersible alumina: 45 g

Fumed alumina: 5 g

After addition of the dispersion the pH increased from 1.60 to 2.00 while the viscosity increase was from 415 cp to 1,826 cp, greater than the increase recorded when only dispersible alumina was used.

EXAMPLE 13

A coating composition was prepared using the same binder described in Example 11 and adding 800 g of aluminum powder (5–10 micron particle size, avg.) to 1,280 g of the binder. The coating was mixed using a high shear mixer.

To 636 g of the coating composition, 10 g of fumed alumina was added by mechanical stirring. The viscosity increased from 664 cp to 1,743 cp. When 160 g of the alumina dispersion described in Example 7 was added to the coating, the viscosity increase was from 1,743 cp to 9,960 cp. Final viscosities of about 10,000 cp were obtained regardless of the mixing order of the aluminas, and represented a viscosity level far in excess of that which could be obtained by either alumina by itself.

The coating composition was used to coat various fasteners by the dipspin method. The fasteners were placed in the dipspin centrifuge basket, dipped into a coating vat containing the composition, removed and spun, spinning off excess coating. The parts were removed from the basket, dried at 175° F., and cured at 650° F. A second coat was applied in the same manner. To make the coating electrically conductive, the cured parts were burnished in a blaster using aluminum oxide grit until the coating was electrically conductive. The coated parts were highly resistant to extreme weathering conditions.

EXAMPLE 14

A coating composition of the type disclosed by Allen (U.S. Pat. No. 3,248,251) was prepared. No pigment was added but hypophosphorous acid was used to partially reduce the chromate.

Magnesium oxide: 300 g
Chromic acid: 231 g
Phosphoric acid (85%): 1,487.5 g
Aluminum hydroxide: 57.8 g
Hypophosphorous acid (50%): 18 g
Water: 3,446 g
Fumed silica: 72.87 g
Mixed oxide black pigment: 790.4 g The mixture was ball milled 4 hours.

To 580 g of the above coating composition, 110 g of a 20% dispersion was added. The dispersion was made according to the following:

Deionized water: 475 g
Dispersible boehmite alumina: 25 g
Fumed alumina: 75 g
Hypophosphorous acid (50%): 30 g The pH of the mixture increased from 2.40 to 2.50. The viscosity increased from 581 cp to 1,079 cp.

Various steel specimens such as screws and fasteners are coated with a base coat similar to the one described in Example 13. When a top coat of this composition is applied to the parts a coating system is created with remarkably improved resistance to salt fog corrosion.

Although the present invention has been described with reference to the most preferred embodiments therein set forth, it is understood that the present disclosure has been made only by way of example and the numerous changes in the details of the compositions may be resorted to without departing from the spirit and scope of the invention. Thus, the scope of the invention should not be limited by the foregoing specification, but rather only by the scope of the claims appended hereto and the functional equivalents.

We claim:

1. A stable thixotropic coating composition for improved resistance to atmospheric and corrosive conditions, which composition is especially suitable for dipspin application which comprises (a) an aqueous acid coating solution which solution comprises phosphate ions and ions of the group consisting of chromate ions or molybdate ions, and (b) a hydrated alumina having a boehmite type crystal lattice dispersed in an acid solution containing a monoprotic acid.

2. The stable thixotropic coating composition of claim 1 wherein the monoprotic acid is selected from the group consisting of nitric acid, hypophosphorous acid and glycolic acid.

3. The stable thixotropic coating composition of claim 1 wherein the alumina has a boehmite crystal lattice.

4. The stable thixotropic coating composition of claim 1 wherein the alumina is a synthetic alumina having a pseudoboehmite crystal lattice.

5. The stable thixotropic coating composition of claim 1 wherein the pH range of the composition is from about 0.5 to about 3.0.

6. The stable thixotropic coating composition of claim 5 wherein the pH range of the composition is from about 1.5 to about 3.0.

7. The stable thixotropic coating composition of claim 1 wherein the viscosity ranges from about 800 to about 50,000 cp.

8. The stable thixotropic coating composition of claim 7 wherein the viscosity ranges from about 1,500 to about 10,000 cp.

9. The stable thixotropic coating composition of claim 1 including fumed alumina.

10. The stable thixotropic coating composition of claim 9 wherein the fumed alumina is present in the amount of 0.25 to 10% by weight of composition.

11. The stable thixotropic coating composition of claim 1 including a nonionic surfactant and fumed silica.

12. The stable thixotropic coating composition of claim 11 wherein the amount of nonionic surfactant is in the range of about 0.01 to about 0.5% by weight of total solids.

13. The stable thixotropic coating composition of claim 11 wherein the nonionic surfactant is from the group of polyoxyethylene, ethoxylated alkylphenol, ethoxylated aliphatic alcohol, carboxylic esters, and polyoxyalkylene oxide block polymers.

14. The stable thixotropic coating composition of claim 11 wherein the amount of fumed silica is in the range of about 0.25 to 10% by weight of total solids.

15. The stable thixotropic coating composition of claim 11 including a nonionic surfactant having a plurality of hydroxyl functional groups.

16. The stable thixotropic coating composition of claim 15 wherein the nonionic surfactant is an ethoxylated alkylphenol.

17. The stable thixotropic coating composition of claim 1 including a nonionic surfactant.

18. The stable thixotropic coating composition of claim 1 including silica.

19. The stable thixotropic coating composition of claim 1 including a particulate solid material selected from the group consisting of aluminum, zinc, an oxide of the following: silicon, zirconium, beryllium or aluminum, iron, chromium, a refractory carbide, nitride, silicide, or boride, or alloys thereof.

20. The stable thixotropic coating composition of claim 19 wherein the particulate solid material is aluminum or an aluminum alloy.

21. The stable thixotropic coating composition of claim 20 wherein the particulate solid material is of an average particle size below about 10 microns.

22. The stable thixotropic coating composition of claim 1 which comprises a gel of a reduced chromate.

23. The stable thixotropic coating composition of claim 22 wherein the gel is of a reduced water-soluble or water-insoluble chromate.

24. The stable thixotropic coating composition of claim 22 wherein the chromate is a dichromate.

25. The stable thixotropic coating composition of claim 24 wherein the gel is an insoluble $Cr(OH)_3$ and/or a $Cr_2(CrO_4)_3$ gel.

26. The stable thixotropic coating composition of claim 1 wherein the acid coating solution comprises dissolved metal ions of the group of magnesium, aluminum or zinc.

27. The stable thixotropic coating composition of claim 1 including fumed alumina in an amount up to 10% by weight of composition; and a nonionic surfactant in an amount of about 0.01 to about 0.5% by weight of total solids.

28. The composition of claim 1 wherein the phosphate and chromate ions are in solution.

29. The composition of claim 1 wherein the pH is in the range from about 0.5 to about 3.0, the viscosity is from about 800 to about 50,000 cp., and the composition is stable against settling into its components for several months at room temperature.

* * * * *